US009728303B2

(12) United States Patent
Kobayashi et al.

(10) Patent No.: US 9,728,303 B2
(45) Date of Patent: Aug. 8, 2017

(54) SHIELDED CABLE

(71) Applicant: SUMITOMO ELECTRIC INDUSTRIES, LTD., Osaka-shi, Osaka (JP)

(72) Inventors: Yuto Kobayashi, Kanuma (JP); Hayato Matsushita, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/964,979

(22) Filed: Dec. 10, 2015

(65) Prior Publication Data

US 2016/0174422 A1 Jun. 16, 2016

(30) Foreign Application Priority Data

Dec. 12, 2014 (JP) ..... 2014-251963
Nov. 26, 2015 (JP) ..... 2015-230289

(51) Int. Cl.

| | |
|---|---|
| ***H01B 7/02*** | (2006.01) |
| ***H01B 11/00*** | (2006.01) |
| ***H01B 3/30*** | (2006.01) |
| ***H01B 11/20*** | (2006.01) |

(52) U.S. Cl.

CPC ..... *H01B 11/002* (2013.01); *H01B 3/30* (2013.01); *H01B 11/203* (2013.01)

(58) Field of Classification Search

USPC ..... 174/102 R, 108, 109, 110 R, 113 R, 174/117 R, 117 F

See application file for complete search history.

(56) References Cited

U.S. PATENT DOCUMENTS

| | | | | |
|---|---|---|---|---|
| 4,855,534 | A * | 8/1989 | O'Connor | H01B 11/1016 156/202 |
| 4,898,640 | A * | 2/1990 | O'Connor | B32B 15/08 156/204 |
| 6,664,466 | B2 * | 12/2003 | Bailey | H01B 11/1091 174/105 R |
| 7,084,348 | B2 * | 8/2006 | Dillon | H01B 7/29 174/113 R |
| 7,827,678 | B2 * | 11/2010 | Dion | H01B 13/262 156/54 |
| 8,916,775 | B2 * | 12/2014 | Tamaki | H01B 11/1025 174/102 R |
| 2011/0247856 | A1 * | 10/2011 | Matsuda | H01B 11/203 174/108 |
| 2014/0182881 | A1 * | 7/2014 | Huang | H01B 11/1091 174/103 |

FOREIGN PATENT DOCUMENTS

| | | | |
|---|---|---|---|
| CN | 2729870 | Y | 9/2005 |
| CN | 203521039 | U | 4/2014 |
| JP | 2011-222262 | A | 11/2011 |

* cited by examiner

*Primary Examiner* — William H Mayo, III

(74) *Attorney, Agent, or Firm* — Drinker Biddle & Reath LLP

(57) ABSTRACT

A shielded cable includes two signal wires, each of which having a signal conductor covered with an insulator, and a shield conductor having a metal clad resin tape spirally wrapped around the two signal wires in a lump. The insulator is configured so that a section thereof is to be deformable by an external force. A residual diameter ratio of the signal wire is 80% or greater and 95% or less when load of 1 kg is applied to the signal wire for 30 minutes.

18 Claims, 8 Drawing Sheets

| | BEFORE DEFORMATION (mm) | AFTER DEFORMATION (mm) | CRUSHING REMAINDER RATIO (%) | EVALUATION |
|---|---|---|---|---|
| SAMPLE 1 | 0.74 | 0.65 | 88 | good |
| SAMPLE 2 | 1 | 0.8 | 80 | good |
| SAMPLE 3 | 1.25 | 0.9 | 72 | poor |
| SAMPLE 4 | 1.59 | 1.17 | 74 | poor |

| | BEFORE DEFORMATION (mm) | AFTER DEFORMATION (mm) | CRUSHING REMAINDER RATIO (%) | EVALUATION |
|---|---|---|---|---|
| SAMPLE 5 | 0.74 | 0.69 | 93 | good |
| SAMPLE 6 | 1 | 0.84 | 84 | good |
| SAMPLE 7 | 1.25 | 1 | 80 | good |
| SAMPLE 8 | 1.59 | 1.27 | 80 | good |

| | BEFORE DEFORMATION (mm) | AFTER DEFORMATION (mm) | CRUSHING REMAINDER RATIO (%) | EVALUATION |
|---|---|---|---|---|
| SAMPLE 9 | 0.74 | 0.7 | 95 | good |
| SAMPLE 10 | 1 | 0.85 | 85 | good |
| SAMPLE 11 | 1.25 | 1 | 80 | good |
| SAMPLE 12 | 1.59 | 1.27 | 80 | good |

SHIELDED CABLE

CROSS-REFERENCE TO RELATED APPLICATION

The present application claims priorities from Japanese Patent Application No. 2014-251963 filed on Dec. 12, 2014 and Japanese Patent Application No. 2015-230289 filed on Nov. 26, 2015, the entire content of which is incorporated herein by reference.

BACKGROUND

Technical Field

The present disclosure relates to a shielded cable, and more particularly, to a shielded cable including signal wires of which two signal conductors are covered with insulators respectively, and a shield conductor having a metal clad resin tape spirally wrapped around the signal wires in a lump.

Related Art

A shielded cable having a plurality of, for example two signal wires as a pair is used to transmit a digital signal in a differential transmission method. According to the differential transmission method, signals a phase of which has been reversed by 180° are input into a pair of signal wires at the same time and are transmitted, and the difference of the signals is detected at a receiver. Thereby, it is possible to double a signal output. Also, a noise signal is equally applied to the pair of signal wires through a transmission path ranging from a sender to a receiver. For this reason, the noise signal is cancelled upon the output at the receiver, so that the noise can be removed.

The pair of signal wires is shielded by a metal foil. However, since the metal foil does not have enough mechanical strength, a metal clad resin tape where a metal foil is attached to a resin tape is used. When the metal clad resin tape are wrapped spirally around the signal wires while a part thereof is overlapped, the overlapped part of the tape is not electrically connected, so that a suck-out phenomenon (dip of signal) may be generated in a high frequency region. Therefore, Patent Document 1 discloses a technology that the metal foils of an upper turn and a lower turn are in contact at the overlapped part.

[Patent Document 1] Japanese Patent Application Publication No. 2011-222262A

In the shielded cable, characteristic impedance is set so that a favorable signal transmission characteristic is obtained in a usable frequency region. The characteristic impedance is varied as a section of the signal wire is deformed. Patent Document 1 does not disclose a relation between the change in the characteristic impedance and the deformation of the signal wire.

SUMMARY

Exemplary embodiments of the invention provide a shielded cable capable of obtaining predetermined characteristic impedance.

A shielded cable according to an exemplary embodiment of the invention, comprises:

two signal wires, each of which having a signal conductor covered with an insulator; and a shield conductor having a metal clad resin tape spirally wrapped around the two signal wires in a lump, wherein the insulator is configured so that a section thereof is to be deformable by an external force, and wherein a residual diameter ratio of the signal wire is 80% or greater and 95% or less when load of 1 kg is applied to the signal wire for 30 minutes.

According to the exemplary embodiment of the invention, it is possible to obtain the predetermined characteristic impedance.

DETAILED DESCRIPTION

Figure 1A:
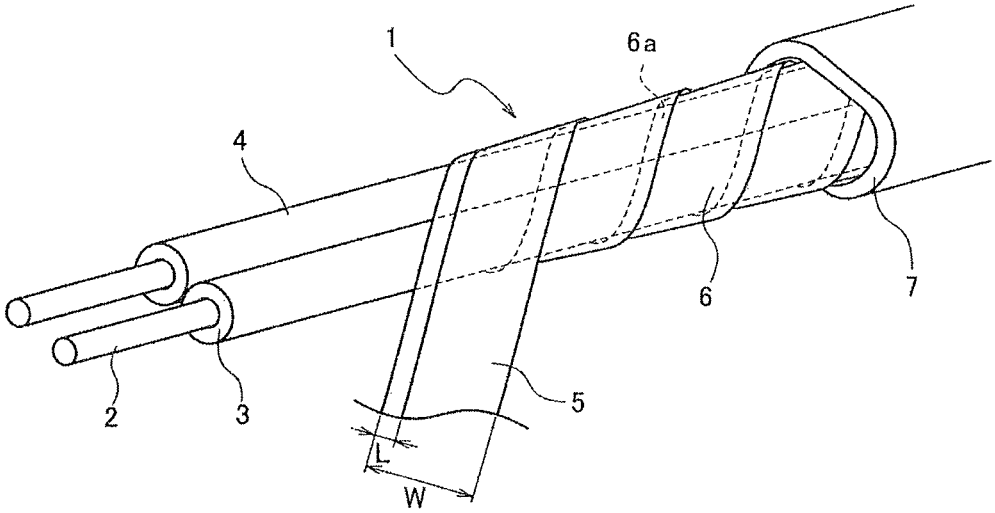
FIG. 1A is showing a shielded cable according to an exemplary embodiment of the invention.

Description of Exemplary Embodiments of the Invention

First, exemplary embodiments of the invention will be described.

(1) A shielded cable according to an exemplary embodiment of the invention is a shielded cable including two signal wires, each of which having a signal conductor covered with an insulator, and a shield conductor having a metal clad resin tape spirally wrapped around the two signal wires in a lump. The insulator is configured so that a section thereof is to be deformable by an external force, and a residual diameter ratio of the signal wire is 80% or greater and 95% or less when load of 1 kg is applied to the signal wire for 30 minutes. Since residual diameter ratio of the signal wire, which represents an extent of deformation of the signal wire in the cross-section thereof, is 80% or greater and 95% or less, characteristic impedance of the cable does not deviate from a designed value. As a result, it is possible to prevent a signal waveform from being deteriorated in a usable frequency region. The residual diameter ratio of the signal wire is a value by dividing a diameter of the signal wire in a flattening direction after deformation when an external force is applied to the insulator by a diameter of the signal wire before deformation.

(2) In the shielded cable, one edge portion of the metal clad resin tape is folded back with a metal foil facing outwardly or inwardly, so that upper and lower metal foils are electrically contacted to each other at an overlapped part of the wrapping of the metal clad resin tape. The shield current linearly flows in parallel with the signal wires, so that it is possible to reduce the suck-out phenomenon.

(3) In the shielded cable, the insulator has one layer and is a foamed layer. In this case, it is possible to easily manufacture the signal wire.

(4) In the shielded cable, the insulator has two layers of which an outer layer is a solid layer and an inner layer is a foamed layer. Since the outer layer having the higher hardness than the inner layer is mainly pressed and flattened, it is more difficult to deform the insulator, and it is possible to easily obtain the predetermined residual diameter ratio, as compared to a case where an easily deformable material is deformed.

(5) In the shielded cable, the insulator has three layers of which an outermost layer and an innermost layer are solid layers and an intermediate layer is a foamed layer. Since the outer layer having the highest hardness between the three layers is mainly pressed and flattened, it is more difficult to deform the insulator, and it is possible to easily obtain the predetermined residual diameter ratio, as compared to a case where an easily deformable material is deformed.

(6) In the shielded cable, a wrapping pitch of the metal clad resin tape is 2.0 mm or greater and 4.0 mm or smaller. In this case, it is possible to remove the suck-out phenomenon while preventing the productivity of the cable from being lowered.

(7) More preferably, the wrapping pitch of the metal clad resin tape is 2.0 mm or greater and 2.5 mm or smaller.

(8) The shielded cable further includes a wrapping member spirally wrapped around the metal clad resin tape. Thereby, it is possible to protect the metal clad resin tape. Also, when the metal foil of the folded-back portion is arranged at an inner side of the wrapping, the metal foil is arranged at an outer side of the wrapping, and thereby, the metal foil can be insulated by the wrapping member.

(9) The shielded cable further includes an outer sheath provided around the metal clad resin tape. Thereby, the metal clad resin tape can be insulated and contaminates from an outside is prevented. Also, it is possible to provide a cable having waterproofness.

Details of Exemplary Embodiments of the Invention

Figure 1B:
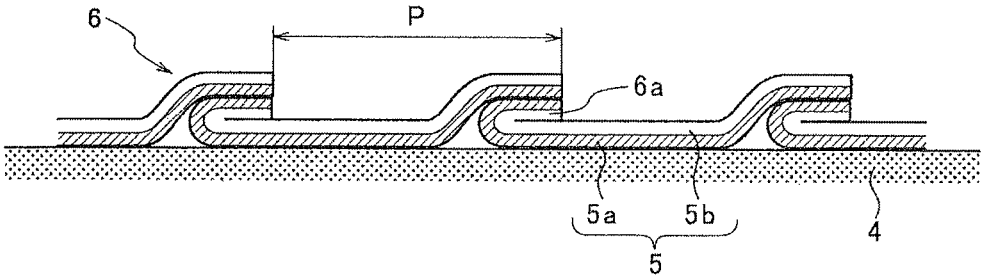
FIG. 1B is showing a shield conductor of FIG. 1A.

The exemplary embodiments of the invention are described in detail with reference to the drawings. FIGS. 1A and 1B show a shielded cable according to an exemplary embodiment of the invention. The shielded cable 1 shown in FIG. 1A is a Twinax cable, for example where a metal clad resin tape 5 is spirally wrapped around two signal wires 4 of which two signal wires are contacted with being aligned in parallel with each other.

The signal wire 4 has a signal conductor 2 covered with an insulator 3. The signal conductor 2 is formed of a single wire of a good electrical conductor such as copper and aluminum or a tin-plated or silver-plated good electrical conductor or a twisted wire of which good electrical conductors are twisted with each other, and a wire material having AWG 20 to 36 (an outer diameter of a conductor is 0.115 mm to 0.910 mm) is used. For the insulator 3, a material having low permittivity is used. For example, polyethylene (PE), ethylene-vinyl acetate (EVA) copolymer, fluorine resin and the like are used. Also, a foamed insulating resin may be used. An outer diameter of the signal wire 4 is about 3.0 mm to 0.15 mm. For example, when the signal conductor 2 having AWG 26 is used, an outer diameter of the signal wire 4 is about 1.25 mm.

The two signal wires 4 are covered with a shield conductor 6. Specifically, the shield conductor 6 is formed by spirally wrapping a metal clad resin tape 5 and is configured to shield the two signal wires 4 in a lump.

As shown in FIG. 1B, the metal clad resin tape 5 is formed by bonding a metal foil 5*a* such as copper and aluminum to a resin tape 5*b* such as polyethylene terephthalate (PET). A thickness of the metal foil 5*a* is 3 μm to 30 μm (preferably, in the case of copper, 6 to 10 μm, for example, 8 μm), a thickness of the resin tape 5*b* is 3 μm to 50 μm (preferably, in the case of PET, 3 to 10 μm, for example, 4 μm), and a thickness of the metal clad resin tape 5 is 6 μm to 80 μm.

The shield conductor 6 may be covered with an outer sheath 7. In this case, the outer sheath 7 is provided by extruding a thermoplastic resin such as polyethylene, polyvinyl chloride, fluorine resin and the like. The outer sheath may also be provided by wrapping a resin tape. The outer sheath 7 is provided, so that the metal clad resin tape 5 can be insulated and contaminates from an outside is prevented. Also, it is possible to provide a cable having waterproofness.

Here, the metal clad resin tape 5 is wrapped at an angle of 8° to 70° relative to an axis orthogonal to a longitudinal direction of the cable, for example, while a part thereof is overlapped. At the overlapped part, the upper and lower metal foils 5*a* are electrically contacted to each other.

Specifically, as shown in FIG. 1B, one edge portion of the metal clad resin tape 5 is folded-back at a folded-back portion 6*a*, and the metal foil 5*a* of the folded-back portion 6*a* is arranged at an outer side of the wrapping. The metal clad resin tape 5 is wrapped on outer peripheries of the signal wires 4 so that the metal foil 5*a* except for the folded-back portion 6*a* is arranged at an inner side. At this time, the metal foil 5*a* of the folded-back portion 6*a* is overlapped with the metal foil 5*a* of an edge portion of a next turn having no folded-back portion 6*a*, so that the upper and lower metal foils 5*a* are electrically contacted to each other. Thereby, a current linearly flows in the shield conductor in parallel with the signal wires 4, so that it is possible to reduce the suck-out phenomenon.

A width L of the folded-back portion 6*a* is preferably about ¼ to ⅔, further preferably, ¼ to ½ of a wrapping width W of the metal clad resin tape 5. For example, in the case of the metal clad resin tape 5 having a width of 7 mm, the width L of the folded-back portion 6*a* is 2 mm, and the width W of the metal clad resin tape 5 is 5 mm.

Also, when the width L of the folded-back portion 6*a* is small, the conduction of the metal foils 5*a* at, the overlapped part may not be sufficient. On the other hand, when the width L of the folded-back portion 6*a* is excessively large, the metal clad resin tape 5 may be useless and the wrapping may have bad posture. For this reason, a width of the overlapped part of the wrapping is preferably ¼ to 5/4 of the width L, further preferably, substantially the same as the width L of the folded-back portion 6*a*. For example, when the width L of the folded-back portion 6*a* is 2 mm, the wrapping is made so that the width of the overlapped part is 2 mm to 2.3 mm.

The metal foil of the folded-back portion may also be arranged at the inner side of the wrapping. In this case, the metal clad resin tape is wrapped on the outer peripheries of the signal wires so that the metal foil except for the folded-back portion is arranged at the outer side.

Also, the metal clad resin tape 5 may be spirally wrapped by a wrapping member (not shown). The wrapping member is a resin tape of PET, for example, and can protect the metal clad resin tape 5. When the metal foil 5*a* of the folded-back portion 6*a* is arranged at the inner side of the wrapping, the metal clad resin tape 5 is wrapped on the outer peripheries of the signal wires 4 so that the metal foil 5*a* except for the folded-back portion 6*a* is arranged at the outer side. The metal foil 5*a* may be insulated by the wrapping member.

FIGS. 2A to 2D show verification results of signal attenuation of the shielded cable shown in FIG. 1A.

Figure 2A:
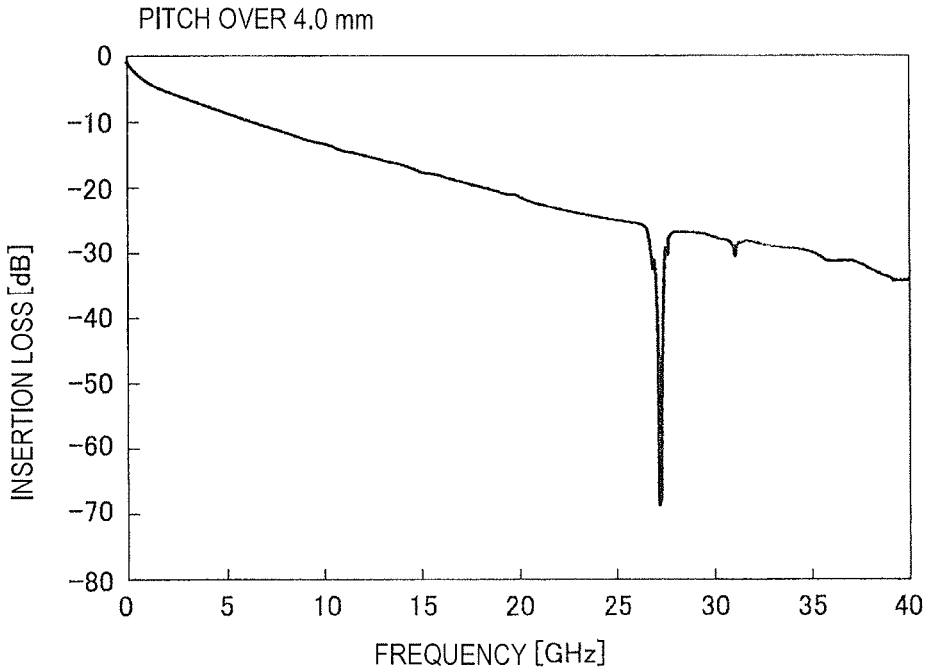
FIG. 2A is showing a verification result (a pitch of over 4.0 mm) of signal attenuation of the shielded cable of FIG. 1A.
Figure 2B:
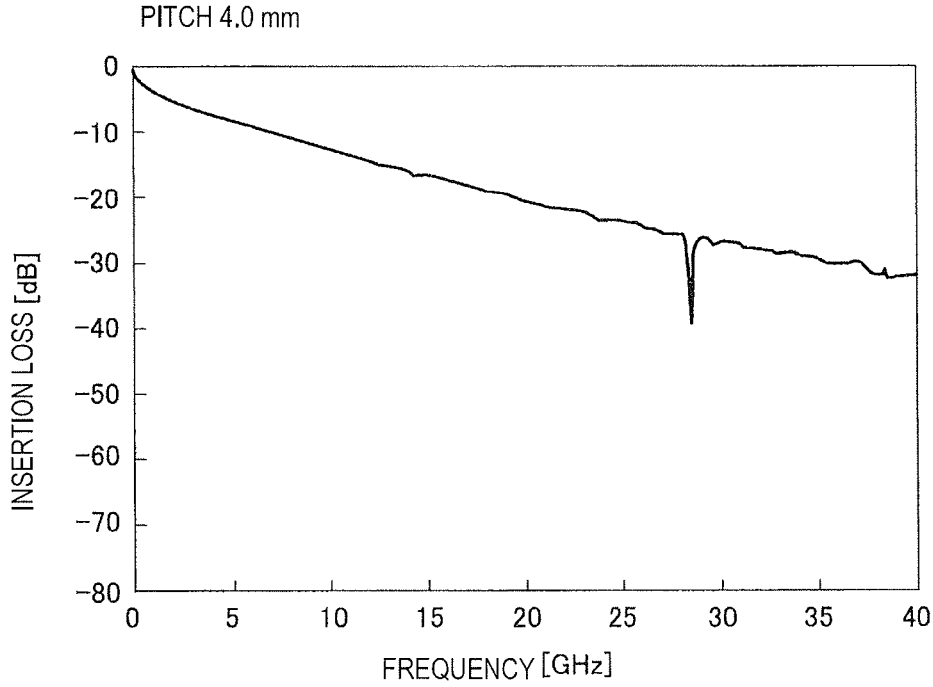
FIG. 2B is showing a verification result (a pitch of 4.0 mm) of signal attenuation of the shielded cable of FIG. 1A.
Figure 2C:
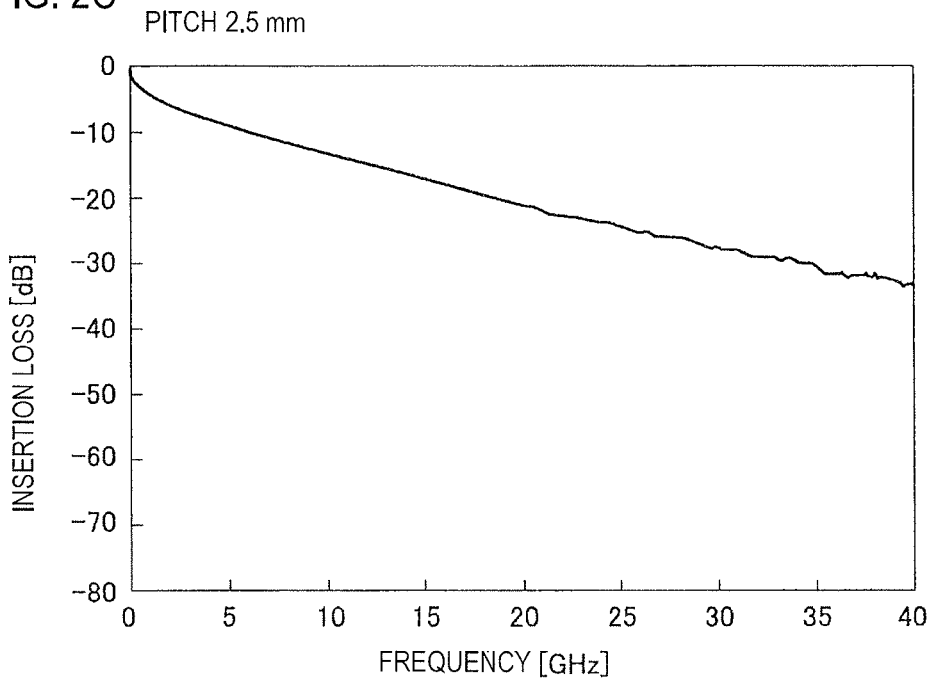
FIG. 2C is showing a verification result (a pitch of 2.5 mm) of signal attenuation of the shielded cable of FIG. 1A.
Figure 2D:
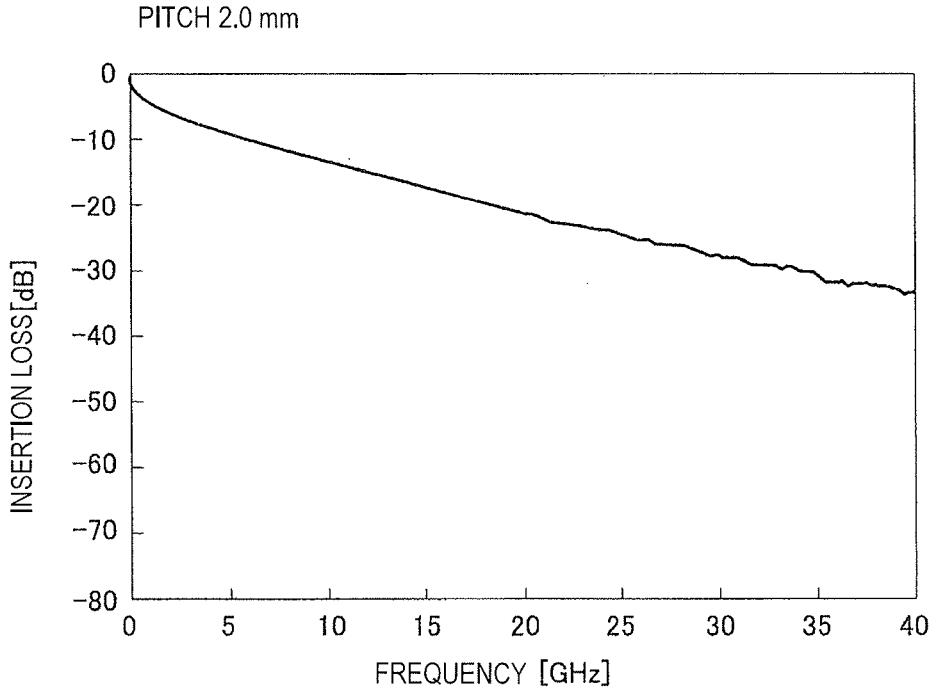
FIG. 2D is showing a verification result (a pitch of 2.0 mm) of signal attenuation of the shielded cable of FIG. 1A.

When a wrapping pitch P (refer to FIG. 1B) of the metal clad resin tape is greater than 4.0 mm, the suck-out phenomenon occurred at 25 GHz to 30 GHz, so that a signal level was lowered, as shown in FIG. 2A. When the wrapping pitch P of the metal clad resin tape is 4.0 mm, the attenuation due to the suck-out phenomenon was reduced, as shown in FIG. 2B. In a case that a frequency of a signal to be transmitted is lower than 25 GHz, the shielded cable of the invention where the wrapping pitch of the metal clad resin tape is 4.0 mm can also be used. When the wrapping pitch P of the metal clad resin tape is 2.5 mm and 2.0 mm, respectively, the suck-out phenomenon did not occur in a frequency range of 40 GHz or lower (FIGS. 2C and 2D). When the wrapping pitch is made to be small, it is difficult to bend the cable, and an amount of the metal clad resin tape to be wound increases which results in poor productivity of the cable. When the pitch is smaller than 2.0 mm, the disadvantages caused by the short pitch cannot be ignored. Therefore, the wrapping pitch of the metal clad resin tape is preferably 2.0 mm or greater and 4.0 mm or smaller, and more preferably 2.0 mm or greater and 2.5 mm or smaller.

Figure 3:
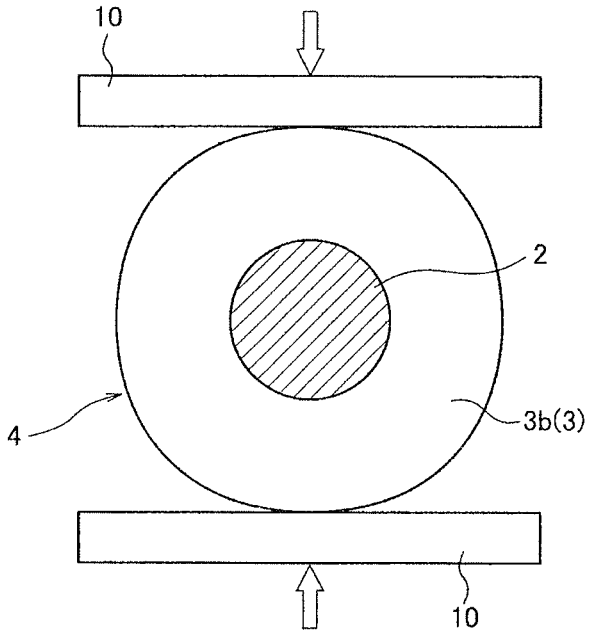
FIG. 3 is showing an example of deformation of a signal wire of FIG. 1A.

The signal wire 4 can be deformed by an external force. Specifically, as shown in FIG. 3, the signal wire 4 having a circular section is sandwiched between two metal plates 10, for example, and is pressed in a direction (for example, an upper and lower direction of FIG. 3) orthogonal to the longitudinal direction of the signal wire 4. The pressing is continued for 30 minutes by load of 1 kg, for example.

Thereby, the insulator 3 is deformed and the outer periphery of the signal wire 4 is flattened at contact positions with the metal plates 10, respectively. The flat portions are not restored even after the pressing is stopped, so that the insulator 3 is kept as it is flattened.

The shielded cable 1 shown in FIG. 1A is manufactured by aligning the two signal wires 4 side by side, each of which can be flattened and has a circular section, and then by shielding the signal wires 4 in a lump with the metal clad resin tape 5.

Figures 4A, 4B:
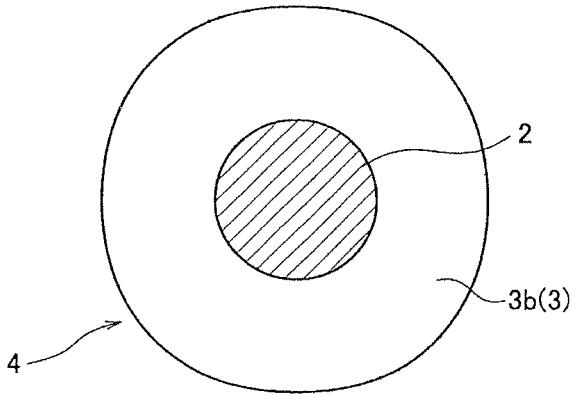
FIG. 4A is showing a shape of the signal wire of FIG. 1A.
FIG. 4B is showing a relation between a change in characteristic impedance of the signal wire of FIG. 1A and deformation of the signal wire.

FIGS. 4A and 4B show a shape of the signal wire shown in FIG. 1A. They show a signal wire of a first example. The insulator 3 shown in FIG. 4A is formed of one layer made of only a main layer 3*b* obtained by mixing low density polyethylene (LDPE) and high density polyethylene (HDPE). Also, the main layer 3*b* is a foamed insulating resin having a predetermined extent of foaming and a predetermined bubble diameter. The insulator is cross-linked.

The signal wire 4 of the cable 1 was taken out, and diameters thereof before and after the pressing were respectively measured to calculate a residual diameter ratio of the signal wire, so that a relation between a change in characteristic impedance and deformation of the signal wire was obtained (FIG. 4B).

A signal wire of a sample 1 has a configuration where a signal conductor having AWG 30 (ϕ 0.254 mm) is covered with an insulator having the main layer 3*b* of a thickness 0.243 mm. The main layer 3*b* has an extent of foaming (a volume ratio of a foamed part in a foamed layer) of 45.5 to 50.3% and a bubble diameter of 20 to 70 μm.

In the case of the sample 1, a diameter of the signal wire before the deformation was 0.74 mm. However, after the deformation, the diameter of the signal wire (for example, a distance between the flat portions formed at the contact positions with the metal plates 10 shown in FIG. 3) was 0.65 mm, and the residual diameter ratio thereof was 88%. The characteristic impedance of the cable using the sample 1 was within a range of 5% with respect to a designed value (100Ω), and a favorable evaluation result was obtained.

A signal wire of a sample 2 has a configuration where a signal conductor having AWG 28 (ϕ 0.352 mm) is covered with an insulator having the main layer 3*b* of a thickness 0.324 mm. The main layer 3*b* has an extent of foaming of 48.0 to 56.2% and a bubble diameter of 20 to 70 μm.

In the case of the sample 2, a diameter of the signal wire before the deformation was 1 mm. However, after the deformation, the diameter of the signal wire (the distance between the flat portions) was 0.8 mm, and the residual diameter ratio thereof was 80%. The characteristic impedance of the cable using the sample 2 was also favorable.

A signal wire of a sample 3 has a configuration where a signal conductor having AWG 26 (ϕ 0.445 mm) is covered with an insulator having the main layer 3*b* of a thickness 0.403 mm. The main layer 3*b* has an extent of foaming of 49.0 to 58.8% and a bubble diameter of 20 to 70 μm.

In the case of the sample 3, a diameter of the signal wire before the deformation was about 1.25 mm. However, after the deformation, the diameter of the signal wire (the distance between the flat portions) was 0.9 mm, and the residual diameter ratio thereof was 72%. The characteristic impedance of the cable using the sample 3 deviated from the designed value (100Ω) by 5% or greater and a favorable evaluation result was not obtained.

A signal wire of a sample 4 has a configuration where a signal conductor having AWG 24 (ϕ 0.562 mm) is covered with an insulator having the main layer 3*b* of a thickness 0.514 mm. The main layer 3*b* has an extent of foaming of 53.7 to 56.6% and a bubble diameter of 20 to 70 μm.

In the case of the sample 4, a diameter of the signal wire before the deformation was 1.59 mm. However, after the deformation, the diameter of the signal wire (the distance between the flat portions) was 1.17 mm, and the residual diameter ratio thereof was 74%. The characteristic impedance of the cable using the sample 4 deviated from the designed value (100Ω) by 5% or greater and a favorable evaluation result was not obtained.

When the signal wire was flattened, if the residual diameter ratio was less than 80%, the characteristic impedance of the cable deviated from the designed value due to the deformation of the section of the signal wire, so that the predetermined characteristic impedance was not obtained. Due to this, the insertion loss is deteriorated. Also, if the residual diameter ratio was less than 80%, the outward appearance of the signal wire was damaged.

Figures 5A, 5B:
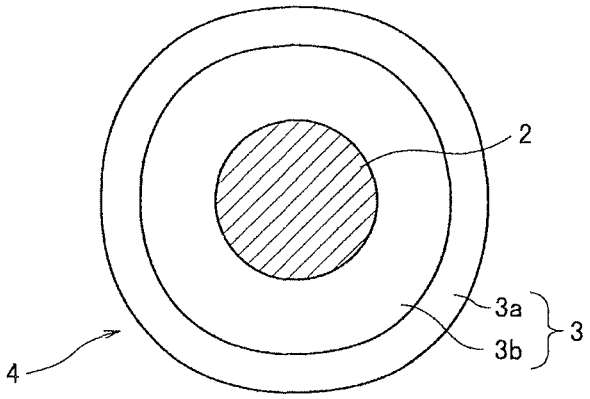
FIG. 5A is showing a signal wire of a second example.
FIG. 5B is showing a relation between a change in characteristic impedance of the signal wire of the second example and deformation of the signal wire.

FIGS. 5A and 5B show a signal wire of a second example.

The insulator 3 shown in FIG. 5A has two layers of an outer layer 3*a* of HDPE and a main layer 3*b* of mixed LDPE and HDPE. The outer layer 3*a* is a solid layer and the main layer 3*b* is a foamed insulating resin. Since the outer layer is a solid layer, the abrasion resistance of the signal wire is good and the shield conductor can be easily attached. Like the first example, a relation between the change in the characteristic impedance and the deformation of the signal wire was obtained (FIG. 5B).

A signal wire of a sample 5 has a configuration where a signal conductor having AWG 30 (ϕ 0.254 mm) is covered with an insulator having the main layer 3*b* of a thickness 0.163 mm and the outer layer of a thickness 0.08 mm. The main layer 3*b* has an extent of foaming of 45.5 to 50.3% and a bubble diameter of 20 to 70 μm.

In the case of the sample 5, a diameter of the signal wire before the deformation was 0.74 mm. However, after the deformation, the diameter of the signal wire (the distance between the flat portions) was 0.69 mm, and the residual diameter ratio thereof was 93%. The characteristic impedance of the cable using the sample 5 was within a range of 5% with respect to the designed value (100Ω), and a favorable evaluation result was obtained.

A signal wire of a sample 6 has a configuration where a signal conductor having AWG 28 (ϕ 0.352 mm) is covered with an insulator having the main layer 3*b* of a thickness 0.244 mm and the outer layer of a thickness 0.08 mm. The main layer 3*b* has an extent of foaming of 48.0 to 56.2% and a bubble diameter of 20 to 70 μm.

In the case of the sample 6, a diameter of the signal wire before the deformation was 1 mm. However, after the deformation, the diameter of the signal wire (the distance between the flat portions) was 0.84 mm, and the residual diameter ratio thereof was 84%. The characteristic impedance of the cable using the sample 6 was also favorable.

A signal wire of a sample 7 has a configuration where a signal conductor having AWG 26 (ϕ 0.445 mm) is covered with an insulator having the main layer 3*b* of a thickness 0.303 mm and the outer layer of a thickness 0.1 mm. The main layer 3*b* has an extent of foaming of 49.0 to 58.8% and a bubble diameter of 20 to 70 μm.

In the case of the sample 7, a diameter of the signal wire before the deformation was about 1.25 mm. However, after the deformation, the diameter of the signal wire (the distance between the flat portions) was 1 mm, and the residual diameter ratio thereof was 80%. The characteristic impedance of the cable using the sample 7 was also favorable.

A signal wire of a sample 8 has a configuration where a signal conductor having AWG 24 (ϕ 0.562 mm) is covered with an insulator having the main layer 3*b* of a thickness 0.414 mm and the outer layer of a thickness 0.1 mm. The main layer 3*b* has an extent of foaming of 53.7 to 56.6% and a bubble diameter of 20 to 70 μm.

In the case of the sample 8, a diameter of the signal wire before the deformation was 1.59 mm. However, after the deformation, the diameter of the signal wire (the distance between the flat portions) was 1.27 mm, and the residual diameter ratio thereof was 80%. The characteristic impedance of the cable using the sample 8 was also favorable.

Figures 6A, 6B:
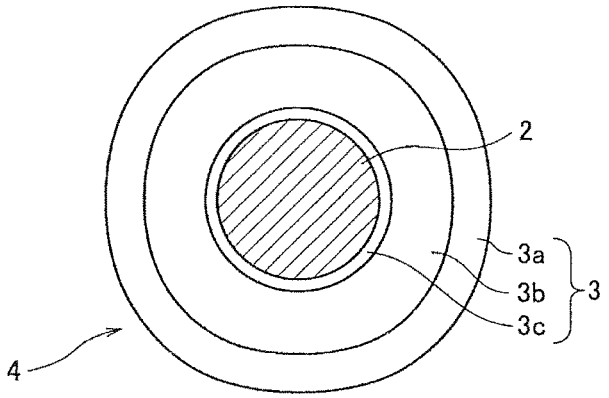
FIG. 6A is showing a signal wire of a third example.
FIG. 6B is showing a relation between a change in characteristic impedance of the signal wire of the third example and deformation of the signal wire.

FIGS. 6A and 6B show a signal wire of a third example.

The insulator 3 shown in FIG. 6A has three layers of an outer layer 3*a* of HDPE, a main layer 3*b* of mixed LDPE and HDPE and an inner layer 3*c* of LDPE. The outer layer 3*a* and the inner layer 3*c* are solid layers. The main layer 3*b* is a foamed insulating resin. Like the first and second examples, a relation between the change in the characteristic impedance and the deformation of the signal wire was obtained (FIG. 6B).

A signal wire of a sample 9 has a configuration where a signal conductor having AWG 30 (ϕ 0.254 mm) is covered with an insulator having the inner layer 3*c* of a thickness 0.02 mm, the main layer 3*b* of a thickness 0.143 mm and the outer layer 3*a* of a thickness 0.08 mm. The main layer 3*b* has an extent of foaming of 45.5 to 50.3% and a bubble diameter of 20 to 70 μm.

In the case of the sample 9, a diameter of the signal wire before the deformation was 0.74 mm. However, after the deformation, the diameter of the signal wire (the distance between the flat portions) was 0.7 mm, and the residual diameter ratio thereof was 95%. The characteristic impedance of the cable using the sample 9 was also favorable.

A signal wire of a sample 10 has a configuration where a signal conductor having AWG 28 (ϕ 0.352 mm) is covered with an insulator having the inner layer 3*c* of a thickness 0.02 mm, the main layer 3*b* of a thickness 0.224 mm and the outer layer 3*a* of a thickness 0.08 mm. The main layer 3*b* has an extent of foaming of 48.0 to 56.2% and a bubble diameter of 20 to 70 μm.

In the case of the sample 10, a diameter of the signal wire before the deformation was 1 mm. However, after the deformation, the diameter of the signal wire (the distance between the flat portions) was 0.85 mm, and the residual diameter ratio thereof was 85%. The characteristic impedance of the cable using the sample 10 was also favorable.

A signal wire of a sample 11 has a configuration where a signal conductor having AWG 26 (ϕ 0.445 mm) is covered with an insulator having the inner layer 3*c* of a thickness 0.02 mm, the main layer 3*b* of a thickness 0.283 mm and the outer layer 3*a* of a thickness 0.1 mm. The main layer 3*b* has an extent of foaming of 49.0 to 58.8% and a bubble diameter of 20 to 70 μm.

In the case of the sample 11, a diameter of the signal wire before the deformation was about 1.25 mm. However, after the deformation, the diameter of the signal wire (the distance between the flat portions) was 1 mm, and the residual diameter ratio thereof was 80%. The characteristic impedance of the cable using the sample 8 was also favorable.

A signal wire of a sample 12 has a configuration where a signal conductor having AWG 24 (ϕ 0.562 mm) is covered with an insulator having the inner layer 3*c* of a thickness 0.02 mm, the main layer 3*b* of a thickness 0.394 mm and the outer layer 3*a* of a thickness 0.1 mm. The main layer 3*b* has an extent of foaming of 53.7 to 56.6% and a bubble diameter of 20 to 70 μm.

In the case of the sample 12, a diameter of the signal wire before the deformation was 1.59 mm. However, after the deformation, the diameter of the signal wire (the distance between the flat portions) was 1.27 mm, and the residual diameter ratio thereof was 80%. The characteristic impedance of the cable using the sample 8 was also favorable.

When the residual diameter ratio was greater than 95%, the outward appearance of the signal wire was not damaged but the characteristic impedance of the cable reduced from the designed value, so that the predetermined characteristic impedance was not obtained.

When the residual diameter ratio was greater than 95% in the signal wire 4 of FIG. 4A or FIG. 5A, the same result as the signal wire 4 of FIG. 6A was obtained. Also, when the residual diameter ratio was less than 80% in the signal wire 4 of FIG. 5A or 6A, the same result as the signal wire 4 of FIG. 4A was obtained.

Therefore, the material, the extent of foaming and the like of the insulator are preferably determined so that the residual diameter ratio of the signal wire becomes 80% or greater and 95% or less when the external force is applied. These sectional deformation extents provide the characteristic impedance of the cable which does not deviate from the designed value. As a result, it is possible to prevent a signal waveform from being deteriorated in a usable frequency region.

Also, in the parallel pair cable of which the two signal wires are wholly shielded with being aligned in parallel with each other, a signal level gently decreased and the suck-out phenomenon did not occur. Also, it was possible to save a delay time of the signal propagating through the respective cores of the cable to an extent of 9 psec/m or less, as compared to a parallel pair cable having the signal wires of which the residual diameter ratio was less than 80% or greater than 95%.

Figure 7A:
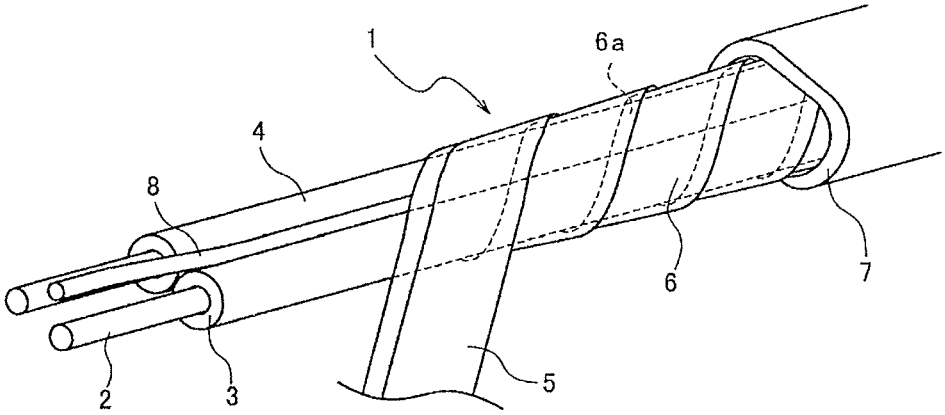
FIG. 7A is showing a shielded cable according to another exemplary embodiment of the invention.
Figure 7B:
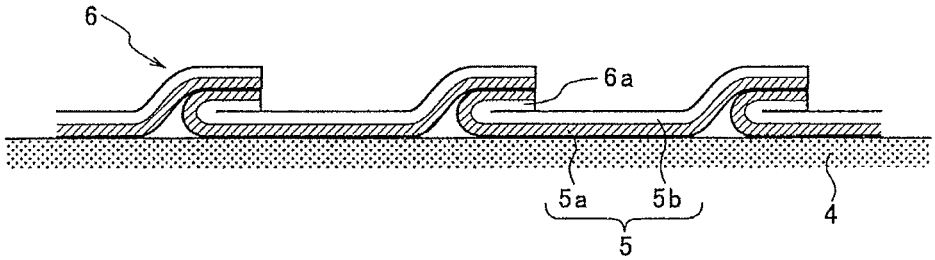
FIG. 7B is showing a shield conductor of FIG. 7A.

FIGS. 7A and 7B show a shielded cable according to another exemplary embodiment of the invention.

As shown in FIG. 7A, the shielded cable 1 has a drain wire 8 that is put in a recess portion (groove), which is formed as the signal wires 4 are aligned in parallel, and is wrapped together with the signal wires 4 by the shield conductor 6. In this case, as shown in FIG. 7B, one edge portion of the metal clad resin tape 5 is folded-back at a folded-back portion 6*a*, and the metal foil 5*a* of the folded-back portion 6*a* is arranged at the outer side of the wrapping (which is the same as FIG. 1B). The metal clad resin tape 5 is wrapped on the outer peripheries of the signal wires 4 so that the metal foil 5*a* except for the folded-back portion 6*a* is arranged at the inner side. At this time, the metal foil 5*a* of the folded-back portion 6*a* is overlapped with the metal foil 5*a* at an edge portion of a next turn having no folded-back portion 6*a*, so that the upper and lower metal foils 5*a* are electrically contacted to each other. The metal foil 5*a* is electrically connected with the drain wire 8, too.

Figure 8:
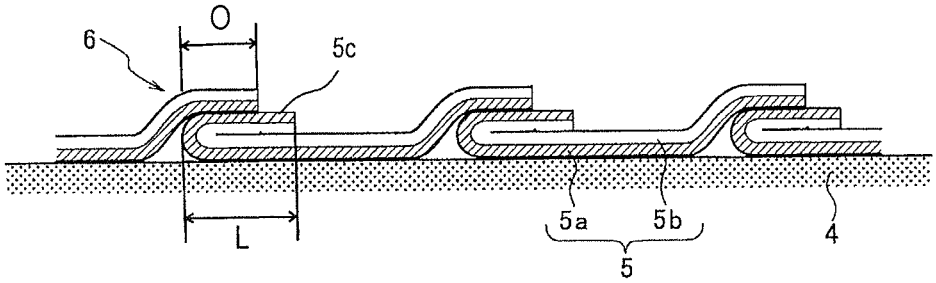
FIG. 8 is showing a shield conductor of a shielded cable according to further another exemplary embodiment of the invention.

As shown in FIG. 8, the width L of the folded-back portion may be longer than the width O of the overlapped part. In this case, a drain wire may be arranged out of the shield conductor. An exposed portion 5*c* of the metal foil 5*a* at the folded-back portion can be electrically contacted with the drain wire which is arranged out of the shield conductor.

It should be noted that the above exemplary embodiments are just exemplary in all aspects and are not limitative. The scope of the invention is defined in the claims, not the above descriptions, and includes the equivalents to the claims and all changes that can be made without departing from the scope of the invention.

What is claimed is:

1. A shielded cable comprising:

two signal wires, each of which having a signal conductor covered with an insulator; and a shield conductor having a metal clad resin tape spirally wrapped around the two signal wires in a lump, wherein the two signal wires are contacted with being aligned in parallel with each other, wherein the insulator comprises a formed layer and is configured so that a section thereof is to be deformable by an external force, and wherein a residual diameter ratio of the signal wire is 80% or greater and 95% or less when load of 1 kg is applied to the signal wire for 30 minutes.

2. The shielded cable according to claim 1, wherein one edge portion of the metal clad resin tape is folded back with a metal foil facing outwardly or inwardly, so that upper and lower metal foils are electrically contacted to each other at an overlapped part of the metal clad resin tape.

3. The shielded cable according to claim 2, further comprising:

a wrapping member spirally wrapped around the metal clad resin tape.

4. The shielded cable according to claim 2, further comprising:

an outer sheath provided around the metal clad resin tape.

5. The shielded cable according to claim 2, wherein the insulator has one layer and is a foamed layer.

6. The shielded cable according to claim 2, wherein the insulator has two layers of which an outer layer is a solid layer and an inner layer is a foamed layer.

7. The shielded cable according to claim 2, wherein the insulator has three layers of which an outermost layer and an innermost layer are solid layers and an intermediate layer is a foamed layer.

8. The shielded cable according to claim 2, wherein a wrapping pitch of the metal clad resin tape is 2.0 mm or greater and 4.0 mm or smaller.

9. The shielded cable according to claim 8, wherein the wrapping pitch of the metal clad resin tape is 2.0 mm or greater and 2.5 mm or smaller.

10. The shielded cable according to claim 2, wherein a wrapping pitch of the metal clad resin tape is 3.5 mm or greater and 4.0 mm or smaller.

11. The shielded cable according to claim 2, further comprising:

a wrapping member spirally wrapped around the metal clad resin tape.

12. The shielded cable according to claim 2, further comprising:

an outer sheath provided around the metal clad resin tape.

13. The shielded cable according to claim 1, wherein the insulator has one layer and is a foamed layer.

14. The shielded cable according to claim 1, wherein the insulator has two layers of which an outer layer is a solid layer and an inner layer is a foamed layer.

15. The shielded cable according to claim 1, wherein the insulator has three layers of which an outermost layer and an innermost layer are solid layers and an intermediate layer is a foamed layer.

16. The shielded cable according to claim 1, wherein a wrapping pitch of the metal clad resin tape is 2.0 mm or greater and 4.0 mm or smaller.

17. The shielded cable according to claim 16, wherein the wrapping pitch of the metal clad resin tape is 2.0 mm or greater and 2.5 mm or smaller.

18. The shielded cable according to claim 1, wherein a wrapping pitch of the metal clad resin tape is 3.5 mm or greater and 4.0 mm or smaller.

* * * * *